US007959542B1

(12) United States Patent
Trudeau

(10) Patent No.: US 7,959,542 B1
(45) Date of Patent: Jun. 14, 2011

(54) DEVICE FOR TRAINING A MARTIAL ARTIST TO KICK

(76) Inventor: Randy Trudeau, St. Ignatius, MT (US)

( * ) Notice: Subject to any disclaimer, the term of this patent is extended or adjusted under 35 U.S.C. 154(b) by 647 days.

(21) Appl. No.: 11/413,312

(22) Filed: Apr. 28, 2006

Related U.S. Application Data

(60) Provisional application No. 60/676,258, filed on Apr. 28, 2005.

(51) Int. Cl.
*A63B 69/34* (2006.01)

(52) U.S. Cl. ..... 482/83

(58) Field of Classification Search ..... 482/83, 482/87, 90, 90.93–138; 272/76, 118, 134; 269/131, 132; 434/247, 258
See application file for complete search history.

(56) References Cited

U.S. PATENT DOCUMENTS

| | | | | |
|---|---|---|---|---|
| 4,807,871 | A | 2/1989 | Bryson | |
| 5,921,896 | A * | 7/1999 | Boland | 482/83 |
| 6,149,554 | A | 11/2000 | Ferguson | |
| 6,585,625 | B1 | 7/2003 | Ferguson | |
| 6,629,733 | B2 * | 10/2003 | Matsuura et al. | 297/366 |
| 6,736,764 | B1 | 5/2004 | Kapustka | |
| 6,802,799 | B2 | 10/2004 | Gomez | |

* cited by examiner

*Primary Examiner* — Xuan M Thai
*Assistant Examiner* — Timothy Musselman
(74) *Attorney, Agent, or Firm* — Jean Kyle

(57) ABSTRACT

A lightweight, portable device trains a martial artist to kick. A riser extends vertically from a base plate and can move pivotally and slidably in relation to the plate. An arm pivotally extends from the riser and supports a kicking pad that moves linearly along the arm. The pad provides resistance to the user executing a kicking motion.

6 Claims, 3 Drawing Sheets

DEVICE FOR TRAINING A MARTIAL ARTIST TO KICK

CROSS-REFERENCE TO RELATED APPLICATIONS

This application claims the benefits of U.S. Provisional Patent Application No. 60/676,258, filed Apr. 28, 2005, the disclosure of which is hereby incorporated by reference in its entirety including all figures, tables and drawings.

BACKGROUND OF THE INVENTION

A number of training devices have been described to help martial artists increase their kicking efficiency (U.S. Pat. Nos. 4,807,871; 6,149,554; 6,585,625 B1; 6,736,764 B1; and 6,802,799 B2). These devices assist in developing kick accuracy and strength. The prior devices however are often cumbersome and difficult to use and adjust. Further, a single device has not yet been described that enhances flexibility and strength by promoting stretching, muscle memory, balance and coordination. A need remains for a lightweight, portable device that is versatile in design and function.

All patents, patent applications, provisional patent applications and publications referred to or cited herein, are incorporated by reference in their entirety to the extent they are not inconsistent with the explicit teachings of the specification.

SUMMARY OF THE INVENTION

The subject invention is a training device for a martial artist. The device can be used to practice kicks as well as punches. A base plate supports an upwardly extending riser. An arm pivots from the riser. A guided linear kicking pad moves along the arm on linear bearings. The kicking pad provides resistance to the kicking motion. The riser pivots and slides upon the base plate and the arm pivots relative to the riser to allow any size person to use the device.

A user standing upon the base plate, positions the pad in the direction of the kick and places his foot on the pad. The user then kicks out pushing the pad along the arm. The kicking motion is guided linearly along the arm with or without resistance.

DETAILED DESCRIPTION OF THE INVENTION

Figure 1:
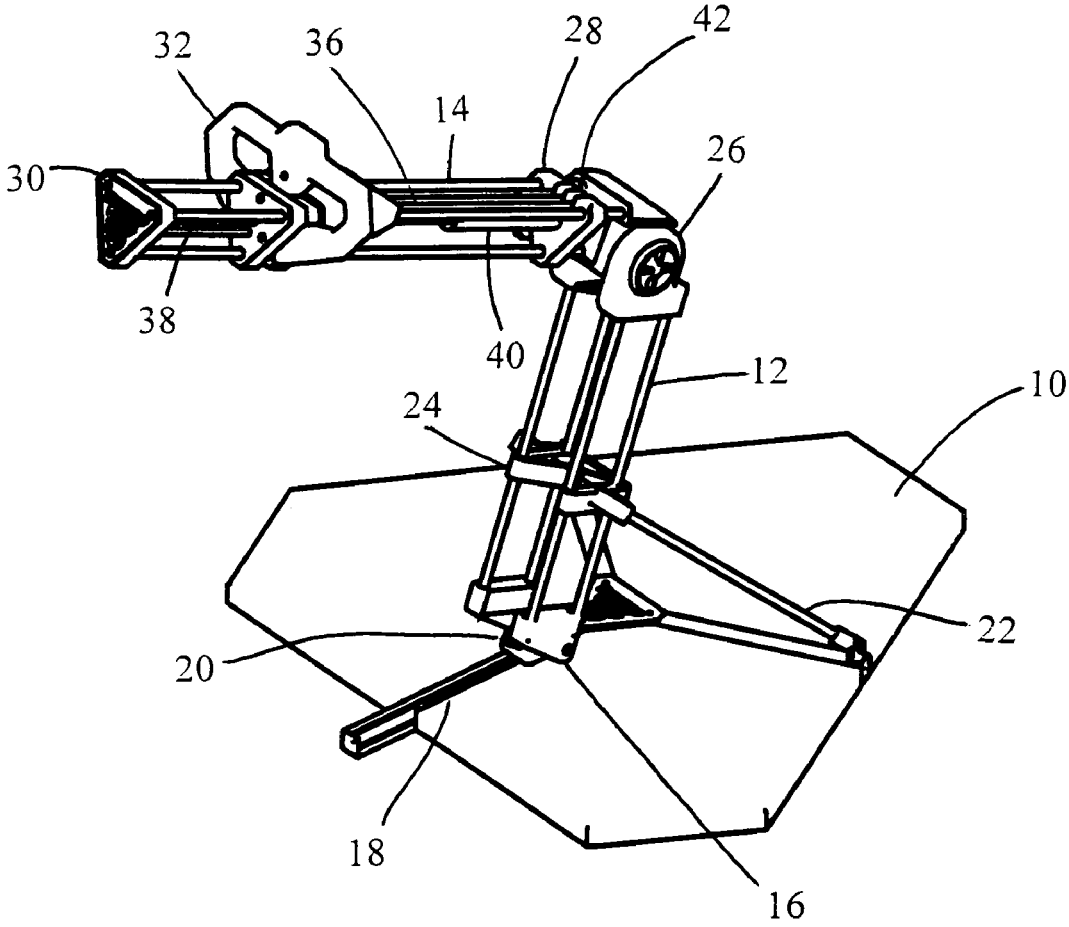
FIG. 1 is a front perspective view of a preferred embodiment of the device of the subject invention.
Figure 2:
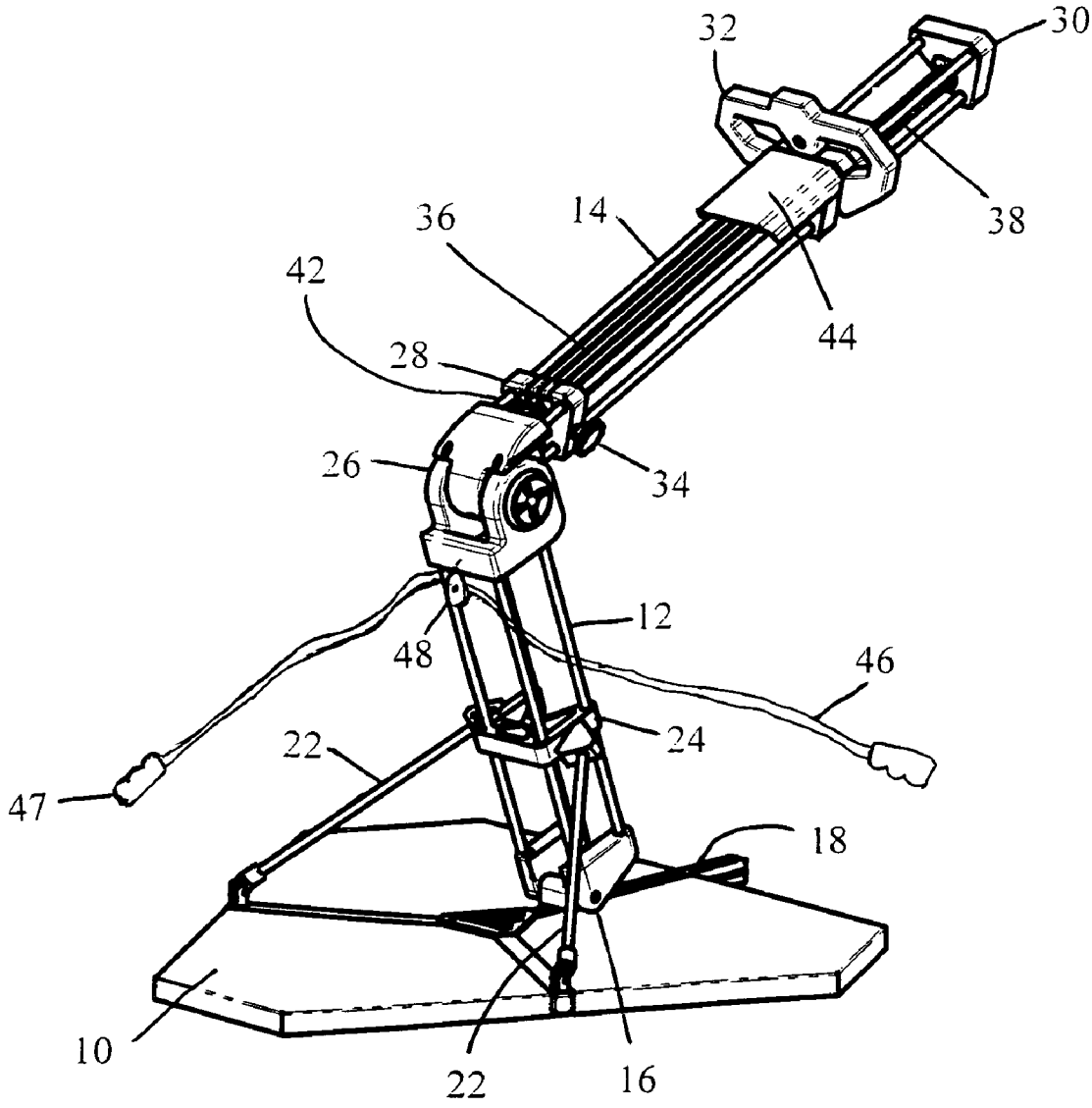
FIG. 2 is a back perspective view of a preferred embodiment of the device of the subject invention.

The invention is a resistance training device that provides linear guided motion (with or without resistance) for martial arts students seeking to obtain extreme flexibility and muscle/motion repetition in a variety of specific kicking forms. It promotes stretching and flexibility foremost, with balance, coordination, timing and strength training as added benefits. A riser extends upwardly from a base plate. A guided linear kicking pad travels along an arm that pivots from the riser. The kicking pad provides resistance to the kicking motion.

A preferred embodiment of the device of the subject invention comprises a base 10, a riser unit 12 and an arm 14. The arm provides the guided linear motion and resistance mechanisms. The base 10 is placed on a horizontal surface or floor 11 and is planar and of a sufficient size for a user to stand on the base plate while using the device. The base plate provides stability to the device and should be heavy enough to support the riser and arm in an upright position. Preferably, the subject device is portable. Therefore in a particularly preferred embodiment, the base is heavy enough and configured to provide sufficient stability to the device but is not too heavy or large to prevent the device from being packed up and carried.

The height of the riser 12 is adjustable relative to the base 10. The height of the riser can be adjusted by, for example, providing a telescoping riser on the device. In a preferred embodiment however the riser is pivotally attached to the base 10 allowing the height of the riser to be adjusted as the riser pivots toward and away from the base. The riser unit is pivotally attached to the base plate 10 by a riser pivot 16. The pivot shown is a simple hinge pivot one skilled in the art would recognize however that any type of pivot could be used on the subject device. An advantage of the exemplified embodiment of the device of the subject invention is that the device can be adjusted to be used by everyone, including children. Placing the lower end of the riser pivot 16 on a sliding track 18 in the base 10 allows the riser 12 to be adjusted to its lowest position relative to the base. A tightening knob 20 clamps to the sliding track 18 to immobilize the riser. The riser 12 is supported by a tripod by two braces 22 via a sliding brace collar 24. In the exemplified embodiment, the riser unit is formed from four bars to reduce the weight of the device. The bars provide the appropriate strength and integrity needed while reducing the overall weight of the device.

The arm 14 is pivotally connected to the end of the riser 12 opposite the riser pivot 16 by an adjustable, locking joint 26. The arm pivots about the riser to allow the user to choose the desired kicking motion and angle for practice. An undetailed locking hinge mechanism is preferred for providing positive locking at the joint between the riser and the arm. It uses a frustro-conical disc shape with teeth engaging an inverted frustro-conical impression. This "beveled gear in a beveled gear dish" is highly effective at transmitting high torque loads yet remaining easily adjustable. Through a combination of the infinite fine angle adjustability of the riser and the three degree interval of the tooth engagement, an infinite range of positive locking angle adjustability is provided. This allows the user to progress in their flexibility with less likelihood of injury. Although the pivot described moves bi-directionally, pivots applicable to the device of the subject invention include those that move multi-directionally as well.

The weight of the device in the exemplified embodiment is again reduced by forming the arm 14 with four arm bars. This configuration provides strength to the arm while remaining light weight. A stop plate 28 and end plate 30 fix the bars into position.

The target or kicking pad 32 moves linearly along the arm and provides resistance of the kicking motion. In the exemplified embodiment, the starting position for the target is adjusted by a knob 34 that clamps to a central rail of the arm. Positioning the target closer to the user affords greater travel under resistance, while positioning the target farther away from the user is easier and somewhat more realistic, since kicking is performed at a greater distance.

Normally, since the foot is in contact with this kicking pad or target from the start to the finish of the leg extension stroke, there is no "aiming" involved, as might be implied by the term "target." However, some advanced users could place the target in a challenging location and aim to kick at it, which supports this designation more directly.

In a preferred embodiment, the guided target mechanism, or kicking pad, employs linear bearings riding on steel shafts, and is intended to be highly tolerant to the eccentric torque loads imposed by kicking. A basic resistance level to the kick is provided by resistance means. In the exemplified embodiment, a primary spring 36 or elastic tubing resists movement of the target along the arm as a user extends their leg. Additional resistance can be added as desired with removable and interchangeable bands of various strength.

The eccentric moment load caused by the kick pad being above the resistance in the exemplified embodiment is harnessed for favorable return strike dampening. Whereas the extension is resisted by bands or springs at the top of the guide, the return stroke is resisted by an adjustable band 38 at the bottom, creating a higher degree of return stroke friction. A urethane bumper 40 stops the return motion inside a protected area 42 of the kick target carriage so as to reduce pinch hazard.

The starting location and starting tension of the kick plate 32 are independently adjustable which reflects the balance between two resistance springs in opposition. In the exemplified embodiment, preference is given to surgical rubber tubing and bungee cord resistance mechanism for their silent operation together with numerous cost and replacement advantages. Other appropriate means of providing resistance include, but are not limited to, hydraulics, pneumatics, inertia, kinetic mass, springs, belts, elastic bands and friction.

To assist in balance and to counteract the reaction force which tends to push the user backwards while kicking, the machine is equipped with handles 46 on a rope 47. The rope passes from each hand through a pulley 48 attached to the power unit at the locking joint 26, allowing the hands to move independently while maintaining the desired amount of pull against the kicking force. The overall rope length is adjustable.

In use, the user stands on the base plate and places his or her foot on the target (and, on its supporting shelf 44). The basic height of the device is adjusted to a comfortable height for the user; usually so the pivot between the riser and arm lies at or below the user's inseam. The lower end of the riser hinges on a sliding track, so that sliding it back and forth raises or lowers the brace pivot and with it, the top of the riser where the riser attaches to the arm. At the desired height, the riser is fixed by tightening a knob which clamps to the track in the base plate, immobilizing it. Now the riser is stable, being supported as a tripod with two braces. Positioning the arm at its lowest possible floor level allows young children to use the device. Additionally, in the lowest position, a user can execute a forward kicking stroke with their foot hooked under cutouts provided on the kicking pad.

The locking joint between the riser and the arm is unlocked and the arm is raised or lowered to the desired angle, then locked in place in the desired kick form. The user then extendes the leg at any desired rate of speed. The joint provides movement of the arm relative to the riser over a range of about 0 to about 180 degrees. At higher angles the user is challenged to stretch by the actual motions of the desired kick, rather than by specific stretches or static stretching machines. This has the benefit of revealing and addressing minor muscle and flexibility imbalances that might otherwise be masked. When a user can systematically visualize, repeat, and coordinate specific motions, the type of flexibility and coordination that is obtained is more helpful in avoiding injury as well as in discovering specific stretching needs.

By allowing the riser to remain at a low angle, the arm 14 can rotate beyond vertical, providing a varied opportunity to use the machine for building upper body strength. If the riser 12 kept horizontal and the arm is held vertically, many types of vertical lift exercises become possible, in the manner of a typical universal gym. The interchangeability of the foot target interface then becomes a considerable advantage.

The subject device is designed for versatility and portability. It folds to a small and practical size which can be transported in an ordinary vehicle trunk or carry bag. It is also capable of being light in weight without use of high cost materials.

Figure 3:
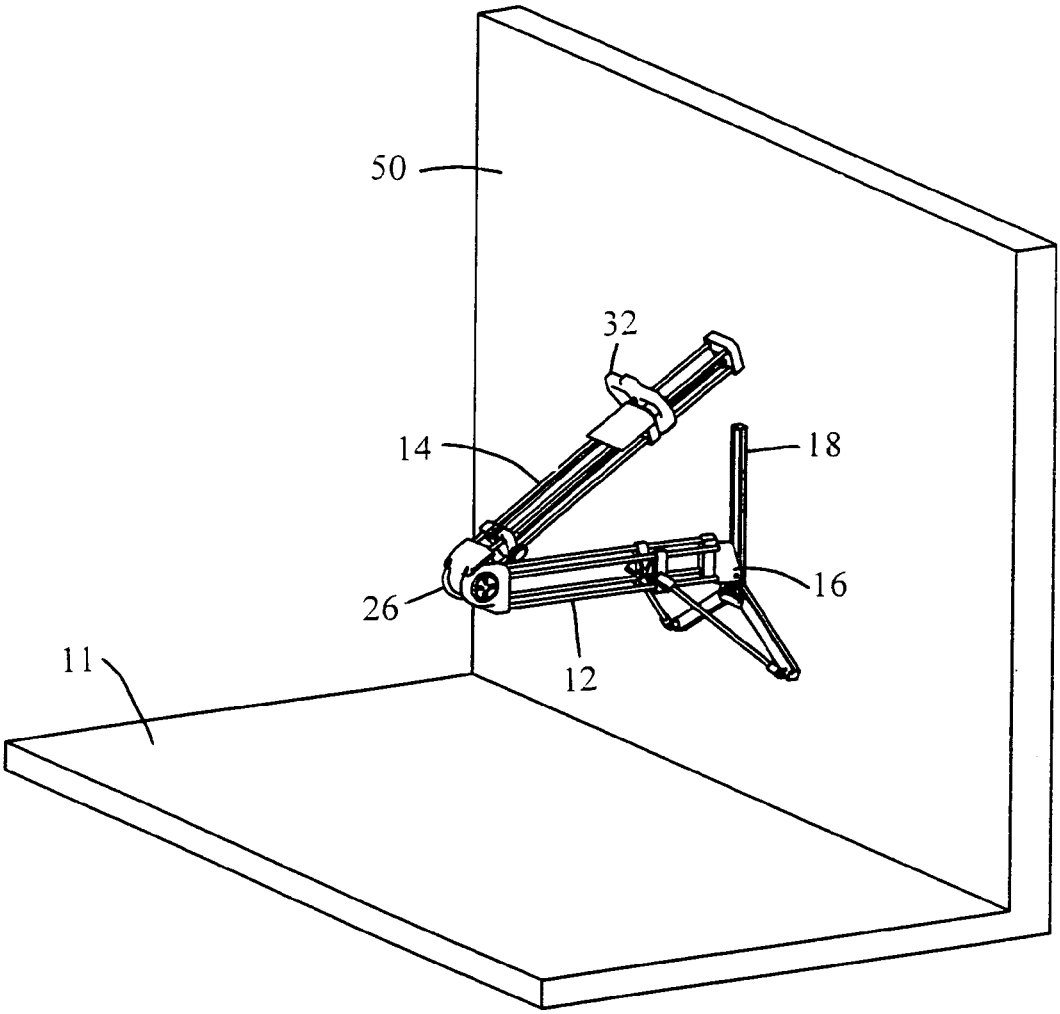
FIG. 3 is a front perspective view of another preferred embodiment of the device of the subject invention.

Another preferred embodiment of the device of the subject invention is shown in FIG. 3. This embodiment is contemplated for use in an institutional setting. The riser and arm mount to a vertical wall 50. Alternatively, a free standing, floor-to-ceiling, version of this device is also contemplated wherein the riser and arm are supported by a framework. Height adjustment of the riser on the wall mounted or free standing device can be accomplished by incorporating sliding channel devices (for example, with locking pins) and/or pivots.

It is understood that the foregoing examples are merely illustrative of the present invention. Certain modifications of the articles and/or methods employed may be made and still achieve the objectives of the invention. Such modifications are contemplated as within the scope of the claimed invention.

The invention claimed is:

1. A device for training an martial artist to kick comprising:
a planar base;
a columnar riser extending from the base, the riser having one end and another end, the one end pivotally and slideably connected to the base so that it is height adjustable relative to the base;
an arm pivotally connected to the other end of the riser by an adjustable, locking pivot; and
a target which moves linearly along the arm;
wherein the martial artist stands on the planar base and moves the target along the arm.

2. The device of claim 1, further comprising resistance means to provide resistance to said target as it moves along said arm.

3. The device of claim 2, wherein said resistance means comprises means to provide resistance as said target moves along said arm away from said locking pivot and means to provide resistance as said target moves along said arm toward said locking pivot.

4. The device of claim 1, wherein said adjustable locking pivot is a frustro-conical beveled gear in a frustro-conical beveled gear dish.

5. A device for training an martial artist to kick comprising:
a planar base;
a columnar riser extending from the base, having one end and another end, the riser pivotally and slideably connected to the base so that it is height adjustable relative to the base;
an arm pivotally and slideably connected to the other end of the riser by an adjustable, locking frustro-conical beveled gear in a frustro-conical beveled gear dish pivot;
a target which moves linearly along the arm; and
resistance means to provide resistance as the target moves along the arm;
wherein the martial artist stands on the planar base and moves the target along the arm.

6. The device of claim 5, wherein said resistance means comprises means to provide resistance as said target moves along said arm away from said locking pivot and means to provide resistance as said target moves along said arm toward said locking pivot.

* * * * *